US006009939A

United States Patent [19]

Nakanishi et al.

[11] Patent Number: 6,009,939

[45] Date of Patent: Jan. 4, 2000

[54] DISTRIBUTED AIR CONDITIONING SYSTEM

[75] Inventors: Ryoji Nakanishi, Gunma-ken; Yoshihiro Nakamura, Saitama-ken, both of Japan

[73] Assignee: Sanyo Electric Co., Ltd., Osaka-fu, Japan

[21] Appl. No.: 08/806,665

[22] Filed: Feb. 26, 1997

[30] Foreign Application Priority Data

Feb. 29, 1996 [JP] Japan ..... 8-042844

[51] Int. Cl.[7] ..... F24F 3/00

[52] U.S. Cl. ..... 165/209; 165/205; 165/288; 236/51

[58] Field of Search ..... 165/205, 209, 165/240, 203, 288; 236/51

[56] References Cited

U.S. PATENT DOCUMENTS

| | | | |
|---|---|---|---|
| 3,384,155 | 5/1968 | Newton | 165/209 |
| 3,709,769 | 1/1973 | Wood | 165/209 |
| 3,716,096 | 2/1973 | Berrett et al. | 165/209 |
| 3,777,803 | 12/1973 | Wood | 165/209 |
| 3,896,871 | 7/1975 | Pecoraro et al. | 165/209 |
| 4,237,966 | 12/1980 | Tomlinson | 165/209 |
| 4,353,409 | 10/1982 | Saunders et al. | 165/240 |
| 4,682,648 | 7/1987 | Fried | 165/209 |
| 4,711,394 | 12/1987 | Samuel | 165/209 |
| 4,716,957 | 1/1988 | Thompson et al. | 165/209 |
| 4,947,928 | 8/1990 | Parker et al. | 165/209 |
| 4,997,029 | 3/1991 | Otsuka et al. | 165/209 |
| 5,181,653 | 1/1993 | Foster et al. | 165/209 |
| 5,279,458 | 1/1994 | DeWolf et al. | 165/209 |
| 5,348,078 | 9/1994 | Dushane et al. | 165/209 |
| 5,427,175 | 6/1995 | Nagasawa | 165/209 |

FOREIGN PATENT DOCUMENTS 6146987 5/1994 Japan .

*Primary Examiner*—Ira S. Lazarus
*Assistant Examiner*—Terrell McKinnon
*Attorney, Agent, or Firm*—Weingarten, Schurgin, Gagnebin & Hayes LLP

[57] ABSTRACT

In a distributed air conditioning system capable of controlling cooling or heating by means of a substitute temperature detector when the room temperature detector of a room to be air conditioned is abnormal, room temperatures detected by the temperature detector D2 of an indoor unit 20, the temperature detector D1 of an operation unit 30 and the temperature detector D3 of a monitoring meter 86 for monitoring the environment of the room 85 to be air conditioned are monitored by a central monitoring and control board 50 and the order of selecting the temperature detectors used for the control of cooling or heating is determined. When a temperature detector selected according to the selection order is abnormal, an alarm for the abnormality is displayed by the central monitoring and control board 50 and a temperature detector which is the next in the selection order is selected to control cooling or heating of the indoor unit. By comparing temperature values detected by the temperature detectors, a temperature detector detecting a temperature value whose differences from other temperature values are equal to or more than a predetermined value is judged to be abnormal. Even when the temperature detector D2 of the indoor unit 20 becomes abnormal, it is possible to control cooling or heating without stopping the operation of the system due to an erroneous cooling or heating operation.

4 Claims, 5 Drawing Sheets

DISTRIBUTED AIR CONDITIONING SYSTEM

BACKGROUND OF THE INVENTION

1. Field of the Invention

This invention relates to temperature control in an distributed air conditioning system.

2. Background Art

The basic configuration of this type of a distributed air conditioning system is such as shown in FIG. 3 that the system comprises a system for cooling or heating air in a room 85 to be air conditioned by providing a heat source 10 for cooling or heating to an indoor unit 20 from a heat source unit 10, a system for setting cooling or heating operation conditions from an operation unit 30 installed in the room 85 to be air conditioned through the indoor unit 20 and monitoring and controlling a required operation out of all the operations by means of a central monitoring and control board 50, and a system for directly monitoring detection values of monitoring meters 86 installed in the room 85 to be air conditioned, for measuring temperature and humidity in the room by means of the central monitoring and control board 50. The term "air conditioning" includes three cases: one where only cooling is carried out, one where only heating is carried out and one where cooling and heating are selectively carried out.

This air conditioning system uses a heat source obtained by a compression refrigerating cycle or an absorption refrigerating cycle. For instance, a system using a heat source obtained by a compression refrigerating cycle is configured to obtain a heat source from a heat operation fluid compressed by a heat source unit 10 as shown in FIG. 3, as disclosed by Laid-open Japanese Patent Application No. Hei 6-146987, for example.

In FIG. 3, circuit portions shown by a double line are pipe lines of a heat operation fluid for obtaining a heat source, e.g., a refrigerant. Circuit portions shown by a thin line are cable lines for electric detection signals and control signals. Since the heat source unit 10 is generally disposed outdoors, it is also called "outdoor unit", but it may be disposed indoors.

The compression section 11 of the heat source unit 10 is a section where a rotary compressor is driven by a drive source such as an engine or a motor to pressurize a heat operation fluid for obtaining a heat source, such as a refrigerant exemplified by freon R22, freon R137 or the like and the pressurized heat operation fluid is provided to a pipe line passing through the heat exchanger 12 of the heat source unit 10 and the heat exchanger 21 of the indoor unit 20 so that the heat operation fluid whose pressure is reduced by the completion of a required heat operation returns to the compression section 11 to be pressurized again.

The passage switching section 13 of the heat source unit 10 is a section for connecting pipe lines in such a manner that the heat exchanger 21 of the indoor unit 20 functions as an absorption heat exchanger and the heat exchanger 12 of the heat source unit 10 functions as a discharge heat exchanger in order to cause the indoor unit 20 to carry out cooling operation, or the heat exchanger 12 of the heat source unit 10 functions as an absorption heat exchanger and the heat exchanger 21 of the indoor unit 20 functions as a discharge heat exchanger in order to cause the indoor unit 20 to carry out heating operation and is a passage switching section for electrically operating a switching valve such as a four-way valve.

The control section 70 of the operation unit 30 stores data on a room temperature value D1A detected by a temperature detector D1, data on operation conditions such as a target temperature value TA for cooling or heating which are set and input by a setting operation section 76, and data on operation start/stop. The control section 70 supplies required data out of these data to the control section 70 of the indoor unit 20 through a communication line 82. Since the operation unit 30 has a function to remotely control the indoor unit, it is generally called "remote controller".

The control section 70 of the indoor unit 20 stores a room temperature value D2A detected by a temperature detector D2, other detection data, data given by the operation unit 30 and the like, controls a flow control valve V2 for supplying a heat operation fluid to the heat exchanger 21 and the quantity of air of a fan (not shown) for supplying air in the room to the heat exchanger 21 so that the room temperature value D2A can reach a target temperature value TA given by the control section 70 of the operation unit 30, and provides required data on operation start/stop and operation conditions to the control section 70 of the heat source unit 10 and the control section 70 of the central monitoring and control board 50 through the communication line 81.

The control section 70 of the heat source unit 10 stores a room temperature value D4A detected by a temperature detector D4, other detection data, data given by the indoor unit 10 and the central monitoring and control board 50, and data on an instruction signal, controls the switching of the flow direction of the passage switching section 13, a flow control valve V1 for supplying a heat operation fluid to the heat exchanger 12, and the quantity of air of a fan (not shown) for supplying air in the room to the heat exchanger 12 based on these data, and provides required data on operation start/stop and operation conditions to the control section 70 of the central monitoring and control board 50 through the communication line 81.

The control section 70 of the central monitoring and control board 50 stores a room temperature value D5A detected by a temperature detector D5, other detection data, data on operation start/stop, operation conditions and the like which are set and input by the setting operation section 76, data given by the indoor unit 10 and the heat source unit 20, and a room temperature value D3A detected by a temperature detector D3 of a monitoring meter 86, displays required data out of these on a display section 77, and provides required data on operation start/stop, operation conditions and the like to the control section 70 of the indoor unit 20 and the control section 70 of the central monitoring and control board 50 through the communication line 81.

Each of the control sections 70 provided in the heat source unit 10, the indoor unit, the operation unit 30 and the central monitoring and control board 50 is mainly composed of a control processing function (to be referred to as "CPU" hereinafter) of a microcomputer and is constructed by using a commercial CPU board (CPU/B) in the control section 70 as shown in FIG. 4, for example. Data obtained from each detection signal obtained by detecting the state of each section and each operation signal input by operating the setting operation section 76 and data provided from other control sections 70 through a communication connection terminal 78 to be described later are taken from an input/output port 71 as input data and stored in a working memory 73 such as a RAM. Each control signal for controlling each section obtained by carrying out required control processing based on these data, a processing flow program prestored in a processing memory 72 such as a ROM and data on reference values stored in a data memory 74, such as an electrically rewritable PROM, that is, EEPROM, as well as data signal to be provided to other control sections 70 are output from the input/output port 71.

A time required for control processing is counted by a timer circuit 75, data on setting conditions such as the operation conditions and control conditions of sections are displayed on the display section 77, and further the communication connection terminal 78 is provided to transmit and receive control data over communication lines 81 and 82 between the control sections 70, such as an extension line of a bus line or a communication cable. This communication connection terminal 78 is formed of a communication connection terminal using a communication IC based on RS485 standards, for example, as required. The communication line 82 between the control section 70 of the operation unit 30 and the control section 70 of the indoor unit 20 may be formed of a radio transmission line for optical communication such as infrared light. In this case, a radio transmission and receiving function for the radio transmission line is provided in the communication connection terminal 78.

In the configuration of FIG. 3, one indoor unit 20 is connected to one heat source unit 10 (to be referred to as "one heat source unit/one indoor unit configuration" hereinafter). Besides, a configuration in which a plurality of indoor units 20 are connected to one heat source unit 10 (to be referred to as "one heat source unit/a plurality of indoor unit configuration" hereinafter) and a configuration in which a plurality of indoor units 20 are connected to a plurality of heat source units 10 (to be referred to as "a plurality of heat source units/a plurality of indoor unit configuration" hereinafter) are already known. Further, in the configuration of FIG. 3, one operation unit 30 is provided for each indoor unit 20 (to be referred to as "one indoor unit/one operation unit configuration" hereinafter). However, a configuration in which one operation unit 30 is shared by a plurality of indoor units 20 (to be referred to as "a plurality of indoor units/one operation unit configuration" hereinafter) is also known.

As for the configuration of the above distributed air conditioning system 100, the heat source unit 10, the indoor unit 20, the operation unit 20 and the central monitoring and control board 50 are installed in separate buildings, or these units are installed in a single building.

Where these units are installed in a single building and the above "one heat source unit/one indoor unit configuration" and "a plurality of heat source units/a plurality of indoor unit configuration" are combined with the central monitoring and control board 50, as shown in FIG. 5, for example, the heat source units 10 are installed on the roof, the indoor unit 20 and the operation unit 30 are installed in each room 85 to be air-conditioned on each floor, and the central monitoring and control board 50 is installed on the lowermost floor, such as a basement. In FIG. 5, each pipe line through which a heat operation fluid flows is depicted by a bold solid line to represent forward and backward pipe lines.

To obtain a heat source by an absorption refrigerating cycle, a group of the compression section 11, the heat exchanger 12 and the passage switching section 13 is changed to a group of an absorber for carrying out heat operation by circulating an absorption solution such as a mixture of water and ammonium, a regenerator, a condenser and an evaporator, and a second heat operation fluid such as water is caused to circulate in a pipe line passing through the evaporator to obtain cold water or hot water and is provided to the heat exchanger 21 of the indoor unit 20.

Like a general air conditioning system, the above distributed air conditioning system 100 of the prior art carries out air conditioning such that a room temperature value D2A detected by the temperature detector D2 provided in the indoor unit 20 which is considered as a substantial room temperature value can reach the target temperature value TA.

However, the temperature detector D2 provided in the indoor unit 20 is liable to malfunction due to the deterioration of detection elements caused by repetitions of vibration of a fan for supplying air in the room to the heat exchanger 21 or dew condensation. When the temperature detector D2 malfunctions, there is such inconvenience that the indoor unit 20 operates erroneously.

To prevent this, the system is generally constituted to stop its operation. Therefore, until the repair of a damaged portion is completed, the room 85 to be air conditioned such as a gust room of a hotel cannot be cooled or heated with the result of such inconvenience that unexpected damage is sustained.

Therefore, it has been desired to provide a distributed air conditioning system free from such inconvenience.

SUMMARY OF THE INVENTION

In order to solve the above mentioned problems of the prior art, a first aspect of the present invention is that, in a distributed air conditioning system for heating or cooling air in a room to be air conditioned by providing a heat operation fluid from a heat source unit to an indoor unit installed in the room based on operation conditions set by an operation unit, comprising a first temperature detector, provided in the indoor unit, for detecting the temperature of air in the room, i.e., room temperature, a second temperature detector, provided in the operation unit, for detecting the above room temperature, and a third temperature detector, provided in the room to be air conditioned to monitor the room temperature by means of a central monitoring and control board, for detecting the room temperature, there is provided cooling or heating control means for controlling cooling or heating based on the room temperature detected by the second temperature detector or the third temperature detector.

A second aspect of the present invention is that, in the same distributed air conditioning system as in the first constitution, there are provided order setting means for presetting the order of selecting one of the first temperature detector, the second temperature detector and the third temperature detector, and selection control means for controlling cooling or heating based on the room temperature detected by the next temperature detector selected according to the above order when the preceding temperature detector is abnormal.

A third aspect of the present invention is that, in a distributed air conditioning system for heating or cooling air in a room to be air conditioned by providing a heat operation fluid from a heat source unit to an indoor unit installed in the room based on operation conditions set by an operation unit, comprising a first temperature detector, provided in the indoor unit for controlling cooling or heating, for detecting the temperature of air in the room, i.e., room temperature, a second temperature detector, provided in the operation unit to monitor the room temperature by means of the operation unit, for detecting the above room temperature, and a third temperature detector, provided in the room to be air conditioned to monitor the room temperature by means of a central monitoring and control board, for detecting the room temperature, there are provided detection temperature substituting means for controlling cooling or heating based on the room temperature value detected by the second temperature detector or the third temperature detector as a substitute for the room temperature detected by the first temperature detector and substitution control means for controlling the substitution by means of the central monitoring and control board according to a predetermined order.

A fourth aspect of the present invention is that, in the same distributed air conditioning system as in the first constitution, there are provided alarm means for alarming that a temperature detector detecting a room temperature whose differences from room temperatures detected by the other temperature detectors are equal to or more than a predetermined value is abnormal and cooling or heating control means for controlling cooling or heating based on the room temperature detected by one of the temperature detectors excluding the temperature detector which is abnormal.

These and other objects and advantages of the present invention will become clear from the following description with reference to the accompanying drawings.

BRIEF DESCRIPTION OF THE DRAWINGS

Out of the following figures.

FIG. 1 is a block diagram showing the entire system;

FIG. 2 is a processing flow chart for controlling key parts;

FIG. 3 is a block diagram showing the entire system;

FIG. 4 is a block diagram of key parts; and

FIG. 5 is a perspective partial sectional view of the total configuration.

DETAILED DESCRIPTION OF THE PREFERRED EMBODIMENTS

Figure 3:
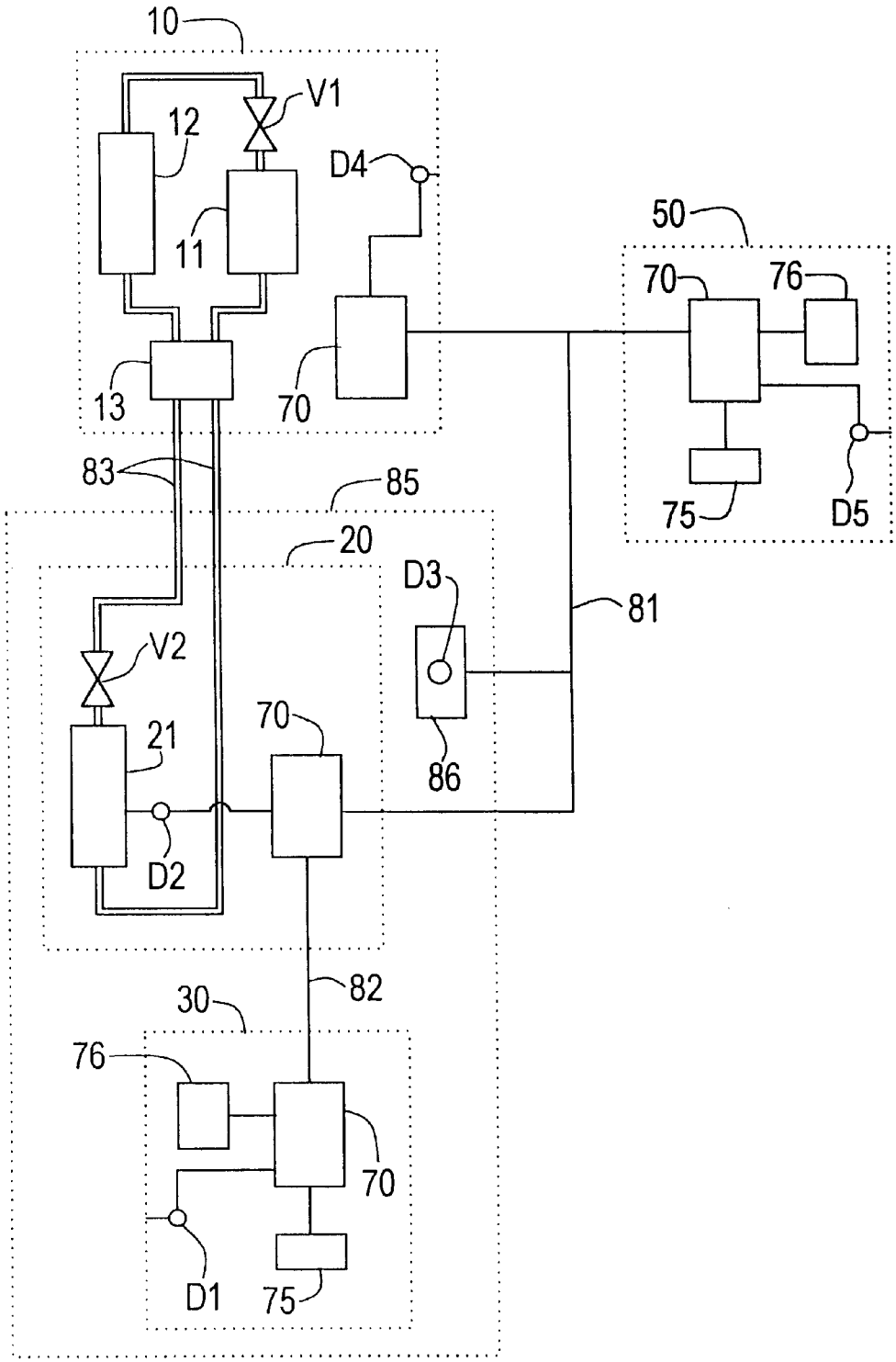
Figure 4:
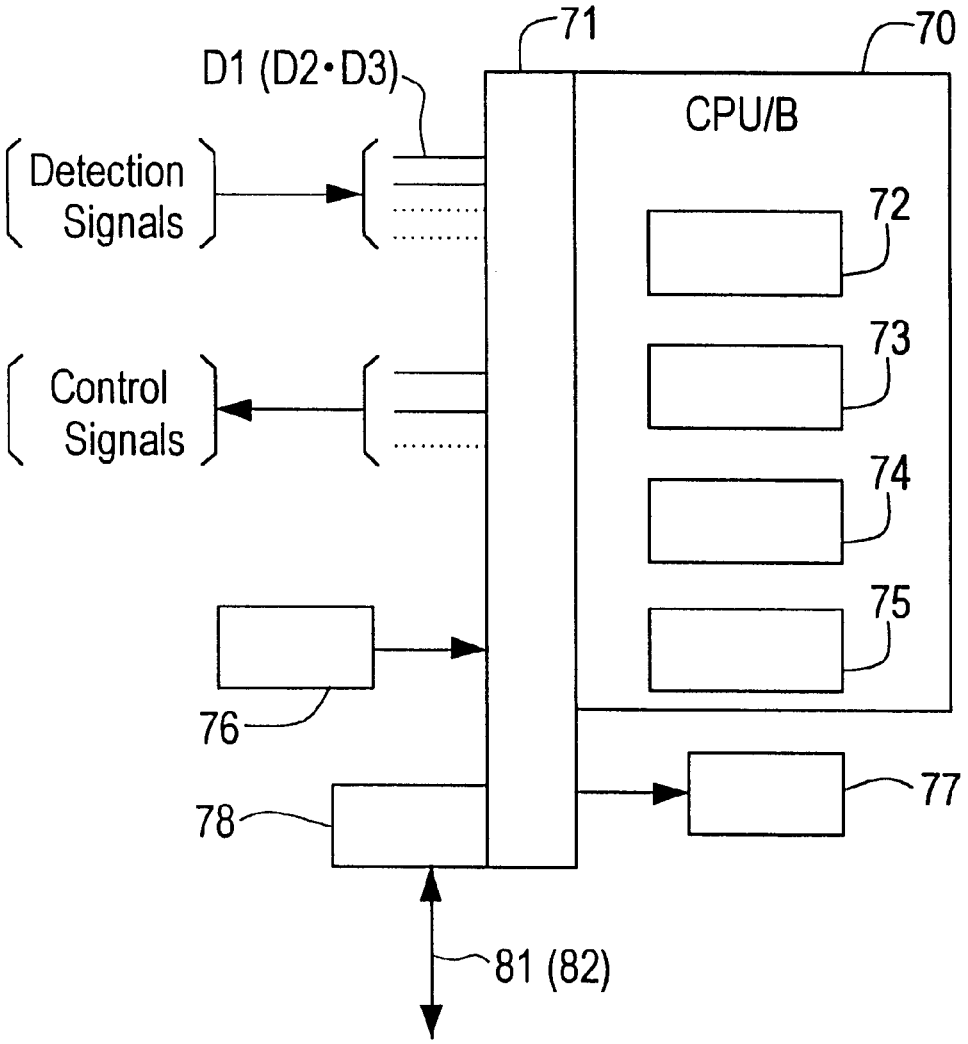
Figure 5:
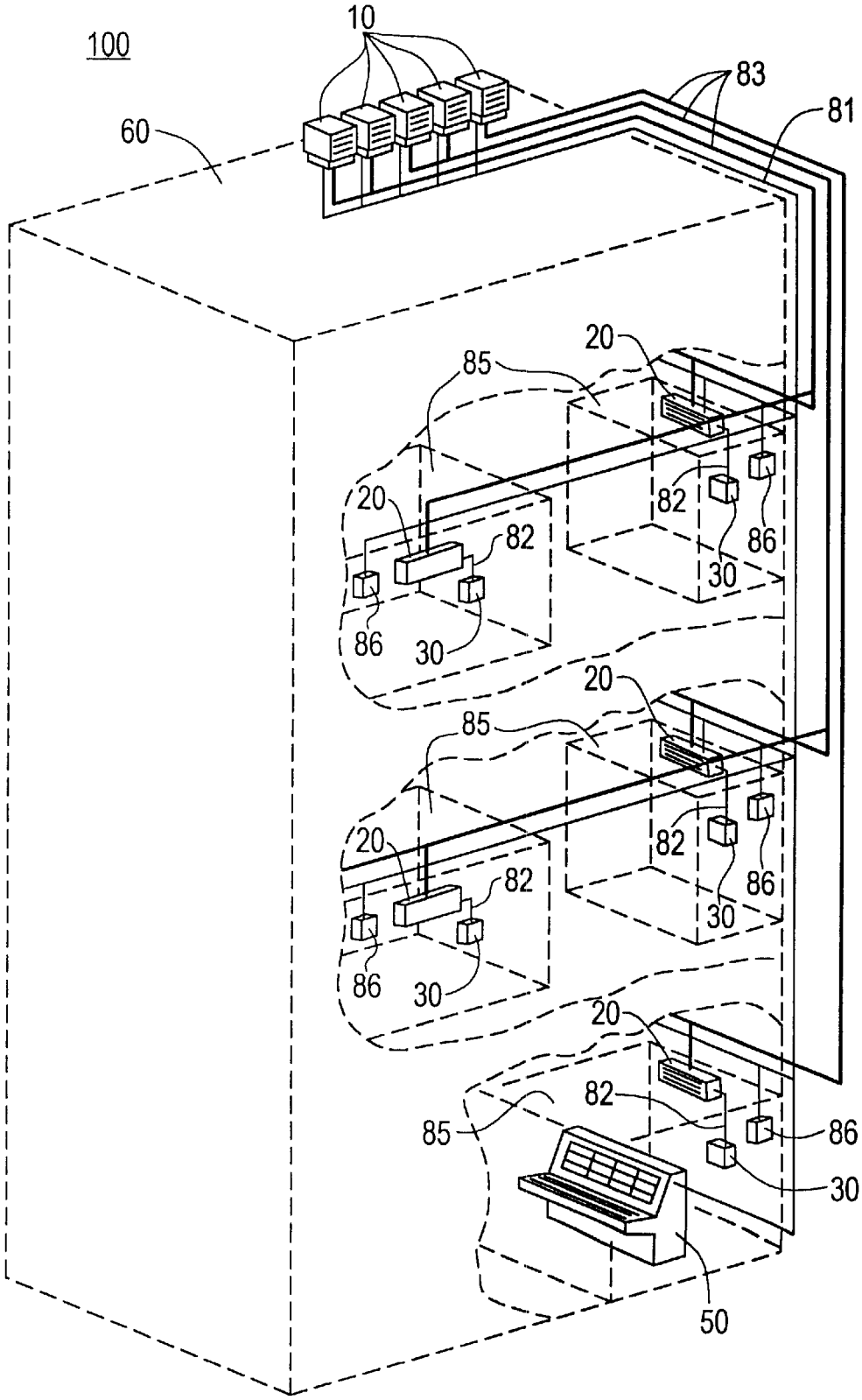

An example where the present invention is applied to a distributed air conditioning system 100 as illustrated in FIGS. 3 to 5 is described below as an embodiment of the present invention.

Figure 1:
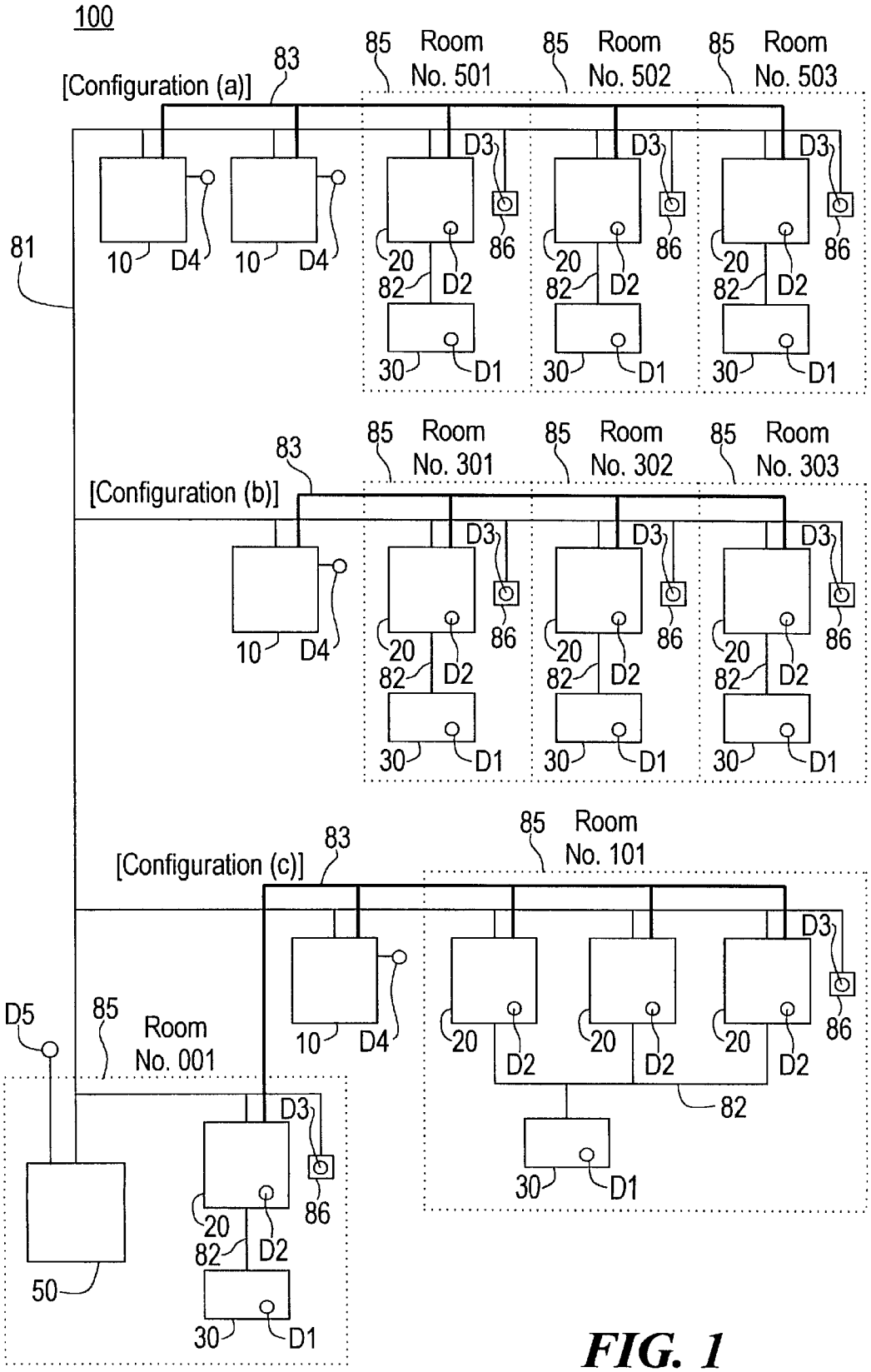
FIGS. 1 and 2 show an embodiment of the present invention and FIGS. 3 to 5 show the prior art.
Figure 2:
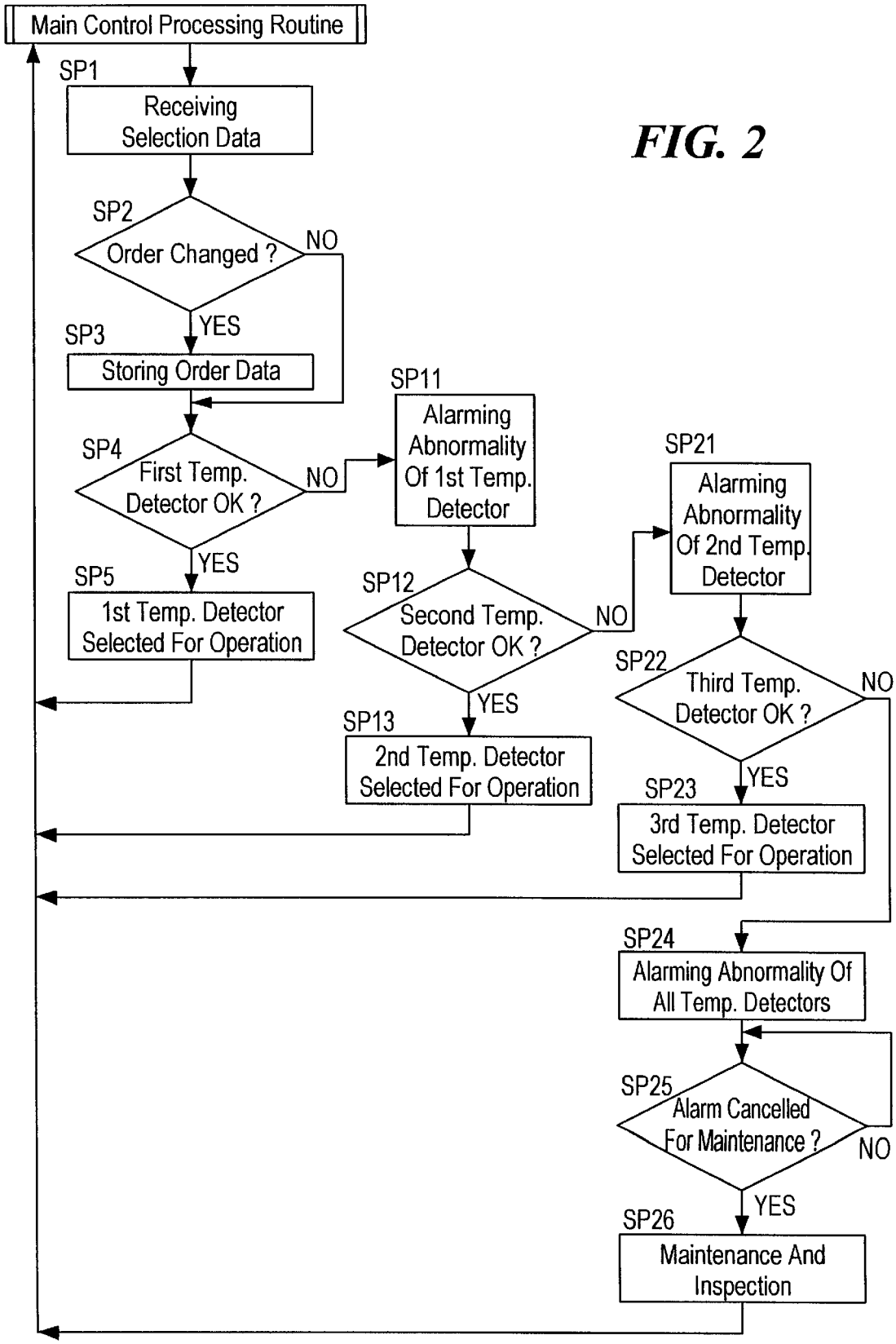

The embodiment of the present invention is described with reference to FIGS. 1 and 2. In FIGS. 1 and 2, parts denoted by the same reference symbols as those in FIGS. 3 to 5 have the same functions as parts denoted by the same reference symbols in FIGS. 3 to 5. In FIGS. 1 and 2, parts denoted by the same reference symbols have the same functions as parts denoted by the same reference symbols as in FIG. 1 or 2. Further, in FIG. 1, each pipe line through which a heat operation fluid flows is shown by a bold solid line as in FIG. 5 to represent forward and backward pipe lines.

FIG. 1, for the convenience of explanation, a configuration (a) is for carrying out cooing or heating by supplying a heat operation fluid from two heat source units 10 to three indoor units 20, that is, the above "a plurality of heat source units/a plurality of indoor unit configuration", and a configuration (b) and a configuration (c) are for carrying out cooling or heating by supplying a heat operation fluid from a single heat source unit 10 to three indoor units 20, that is, the above "one heat source unit/a plurality of indoor unit configuration".

Further, each of the rooms 85 to be air conditioned of the configuration (a) and configuration (b), that is, rooms Nos. 501, 502, 503, 301, 302 and 303, and room No. 001 out of the rooms 85 to be air conditioned of the configuration (c) are provided with one operation unit 30 for each indoor unit 20, that is, the above "one indoor unit/one operation unit configuration", room No. 101 out of the rooms 85 to be air conditioned of the configuration (c) is provided with one operation unit 30 for a plurality of indoor units 20, that is, "a plurality of indoor units/one operation unit configuration", and the system consists of a combination of a plurality of different configurations.

However, the present invention can be applied not only to such a complicated system but also to a system employing one or more of the "one heat source unit/one indoor unit configuration", "one heat source unit/a plurality of indoor unit configuration" or "a plurality of heat source units/a plurality of indoor unit configuration", or a system employing only one of the "one indoor unit/one operation unit configuration" and "a plurality of indoor units/one operation unit configuration".

In FIG. 1, the control section 70 of the central monitoring and control board 50 stores the temperatures of air in the room detected by the temperature detectors D1, D2, D3 of each room 85 to be air conditioned, that is, data on room temperature values D1A, D2A, D3A, in a working memory 73 when necessary, stores data on reference values required for judging an abnormality in each of the temperature detectors D1, D2, D3, data on the order of selecting the temperature values D1A, D2A, D3A detected by the temperature detectors D1, D2, D3 and the like in a data memory 74, and is constituted such that it can carry out control processing of judgment on an abnormality in each of the temperature detectors D1, D2, D3 for each of the rooms 85 to be air conditioned, selection of one detection value from room temperature values D1A, D2A, D3A for controlling cooling or heating, and an alarm for an abnormality in the temperature detector according to a program for the control processing flow of FIG. 2 stored in the processing memory 72.

The selection order is stored and held in the data memory 74 each time it is changed or set. The initial setting of the selection order is stored in the data memory 74 by operating a predetermined operation key of the setting operation section 76 at the time of producing or installing the system. When a monitoring operator changes the selection order by operating the predetermined operation key of the setting operation section 76, the change data is temporarily stored in the working memory 73 and restored in the data memory 74 in a predetermined stage of the control processing flow.

[Judgment on an Abnormality in Room Temperature Detector]

It may be considered that it is almost impossible that the temperature detectors D1, D2, D3 become abnormal simultaneously. Since it is common in the case of an abnormality that a detected temperature value greatly differs from an actual temperature value, temperature differences among room temperatures D1A, D2A, D3A detected by the temperature detectors D1, D2, D3 in each room 85 to be air conditioned are calculated and a temperature detector detecting a room temperature whose differences from other room temperatures are equal to or more than a predetermined value can be judged as an abnormal temperature detector.

In other words, when the room temperature value D1A detected by the temperature detector D1 is 23° C., the room temperature value D2A detected by the temperature detector D2 is 41° C., and the room temperature value D3A detected by the temperature detector D3 is 24° C., the temperature differences among these room temperature values are 24° C.−23° C.=1° C., 41° C.−24° C.=17° C., and 41° C.−23° C.=18° C. When the predetermined value TA is 10° C., the temperature detector detecting a room temperature whose differences from other temperature values are equal to or more than the predetermined value is the temperature detector D2. Therefore, this temperature detector D2 may be judged to be abnormal from a view point of the other two room temperature values D1A, D3A as a matter of course. This judgement is called "first judgement" hereinafter.

When this abnormal temperature detector D2 is made the last in the selection order and cooling or heating is controlled based on a room temperature detected by other temperature detector D1 or D3, erroneous control of cooling or heating will not take place.

When one of the other temperature detectors D1, D3 becomes abnormal, a temperature detector detecting a room temperature whose difference from the previously detected room temperature value is equal to or more than the predetermined value of 10° C. can be judged to be abnormal. This judgement is called "second judgement" hereinafter.

By giving an alarm that the temperature detector D2 is abnormal, the monitoring operator notices the abnormality and maintains and repairs the abnormal temperature detector. Therefore, the abnormality does not last for a prolonged time and the three temperature detectors D1, D2, D3 return to normal operation, whereby judgment based on the temperature differences can be carried out again.

Therefore, the above predetermined value TA is stored in the data memory 74 as a reference value to carry out the above judgements. Since temperature variations by the control of cooling or heating slightly fluctuate, the above judgments are carried out based on the average of temperature values obtained for a predetermined time period, e.g., about 10 sec.

[Explanation of Control Processing Flow]

The control processing flow of FIG. 2 is described below. This control processing flow is a sub-routine in which a regular control processing flow to be carried out by the control section 70 of the central monitoring and control board 50 is a main control processing flow and the system proceeds to the control processing flow of FIG. 2 based on operation data sent from the control section 70 of each indoor unit 20.

In the control processing flow of FIG. 2, only control processing is carried out for a single indoor unit 20. Where a plurality of indoor units 20 are installed, similar control processing is carried out for each of the indoor units 20. Suppose that control processing is carried out for the indoor unit 20 of room No. 501, for example, and the temperature detector D2 is the first, the temperature detector D2 the second, and the temperature detector D3 the third in the initial "selection order" in FIG. 2.

In step SP1, data on the "selection order" stored in the data memory 74 and change data on the "selection order" stored in the working memory 73 are fetched and the routine proceeds to the next step SP2.

In step SP2, it is judged whether there is change data on the "selection order". When there is change data, the routine proceeds to the next step SP3 and when there is no change data, the routine proceeds to step SP4.

In step SP3, data on the "selection order" stored in the data memory 74 is replaced by the change data on the "selection order" stored in the working memory 73, i.e., updated and the routine proceeds to the next step SP4.

In step SP4, it is judged whether the temperature detector which is the first according to the data on the "selection order" is OK or not, i.e., normal or not. When it is normal, the routine proceeds to the next step SP5 and when it is not, the routine proceeds to step SP11. However, when this temperature detector has already been judged to be abnormal by the previous judgment, the routine proceeds to step SP11. This judgment is the first judgment described above.

In step SP5, data for sending to the indoor unit 20 an instruction data for controlling cooling or heating based on the room temperature value D2A detected by the temperature detector D2 which is the first in the "selection order" is prepared and the routine proceeds to a predetermined step of the main control processing flow.

In step SPIl, the display section 77 such as a liquid crystal display is caused to display an alarm that the temperature detector D2 which is the first in the "selection order" is abnormal and then the routine proceeds to the next step SP12. This alarm can be given visually or by sound, e.g., buzzer sound. When an alarm for the abnormality of the temperature detector which is the first in the "selection order" has already been given, the routine proceeds to the next step SP12.

In step SP12, it is judged whether the temperature detector D1 which is the second according to data on the "selection order" is OK or not, that is, normal or not. When it is normal, the routine proceeds to the next step SP13 and when it is not, the routine proceeds to step SP21. When the temperature detector which is the second in the "selection order" has already been judged to be abnormal by the previous judgment, the routine proceeds to step SP21. This judgment is the second judgement described above.

In step SP13, data for sending to the indoor unit 20 an instruction data for controlling cooling or heating based on the room temperature value D1A detected by the temperature detector D1 which is the second in the "selection order" is prepared and the routine proceeds to a predetermined step of the main control processing flow.

In step SP21, an alarm that the temperature detector D1 which is the second in the "selection order" is abnormal is displayed in the same manner as in the above step SP11 and the routine proceeds to the next step SP22. When an alarm for the abnormality of the temperature detector which is the second in the "selection order" has already been given, the routine proceeds to the next step SP22.

In step SP22, it is judged whether the temperature detector D3 which is the third according to data on the "selection order" is OK or not, that is, normal or not. When it is normal, the routine proceeds to the next step SP23 and when it is not, the routine proceeds to step SP24. When the temperature detector which is the third in the "selection order" has already been judged to be abnormal by the previous judgment, the routine proceeds to the next step SP24. This judgment is the second judgement described above.

In step SP23, data for sending to the indoor unit 20 an instruction data for controlling cooling or heating based on the room temperature value D3A detected by the temperature detector D3 which is the third in the "selection order" is prepared and the routine proceeds to a predetermined step of the main control processing flow.

In step SP24, an alarm for abnormality is displayed for all the temperature detectors D1, D2, D3 in the same manner as in the above step SP11 and the routine proceeds to the next step SP25. When an alarm for the abnormality of the temperature detector which is the third in the "selection order" has already been given, the routine proceeds to the next step SP25.

In step SP25, it is judged whether data indicating that an alarm has been canceled for maintenance and inspection works is input by the monitoring operator with the predetermined operation key of the setting operation section 76. When the data is input, the routine proceeds to the next step SP26 and when it is not, this step SP25 is repeated.

In step SP26, data for sending to the indoor unit 20 of room No. 501 an instruction data for controlling for maintenance and inspection works is prepared and the routine proceeds to a predetermined step of the main control processing flow.

[Summary of Constitution of the Embodiment]

When the constitution of the above embodiment is summarized, there are provided:

(1) first constitution that, in a distributed air conditioning system 100 for heating or cooling air in a room 85 to be air conditioned by providing a heat operation fluid from a heat source unit 10 to an indoor unit 20 installed in the room 85 based on operation conditions set by an operation unit 30, comprising a first temperature detector D2, provided in the indoor unit 20, for detecting the temperature of air in the room, i.e., room temperature, a second temperature detector D1, provided in the operation unit, for detecting the above room temperature, and a third temperature detector D3, provided in the room 85 to be air conditioned to monitor the room temperature by means of a central monitoring and control board 50, for detecting the room temperature, there is provided cooling or heating control means for controlling cooling or heating based on the room temperature detected by the second temperature detector D1 or the third temperature detector D3;

(2) second constitution that, in the same distributed air conditioning system 100 as in the first constitution, there are provided order setting means for presetting the order of selecting one of the first temperature detector D2, the second temperature detector D1 and the third temperature detector D3, that is, "selection order" by operating the setting operation section 56 of the central monitoring and control board 50 and selection control means for controlling cooling or heating based on the room temperature detected by the next temperature detector selected according to the above order when the preceding temperature detector is abnormal;

(3) third constitution that, in a distributed air conditioning system 100 for heating or cooling air in a room 85 to be air conditioned by providing a heat operation fluid from a heat source unit 10 to an indoor unit installed in the room 85 based on operation conditions set by an operation unit 30, comprising a first temperature detector D2, provided in the indoor unit 20 for controlling cooling or heating, for detecting the temperature of air in the room, i.e., room temperature, a second temperature detector D1, provided in the operation unit 30 to monitor the room temperature by means of the operation unit 30, for detecting the above room temperature, and a third temperature detector D3, provided in the room 85 to be air conditioned to monitor the room temperature by means of a central monitoring and control board 50, for detecting the room temperature, there are provided detection temperature substituting means for controlling cooling or heating based on the room temperature value detected by the second temperature detector D1 or the third temperature detector D3 as a substitute for the room temperature detected by the first temperature detector D2 in accordance with the control processing flow of FIG. 2, for example, and substitution control means for controlling the substitution by means of the central monitoring and control board 50 according to a predetermined order by causing the control section 70 of the central monitoring and control board 50 to control in accordance with the control processing flow of FIG. 2, for example; and (4) fourth constitution that, in the same distributed air conditioning system 100 as in the first constitution, there are provided alarm means for alarming that the temperature detector detecting a room temperature whose differences from room temperatures detected by the other temperature detectors are equal to or more than a predetermined value is abnormal according to the above first judgment and cooling or heating control means for controlling cooling or heating based on the room temperature detected by one of the temperature detectors excluding the temperature detector which is abnormal according to the control processing flow of FIG. 2, for example.

[Modifications of the Embodiment]

The present invention may be modified as follows.

(1) In the control processing flow of FIG. 2, in the step SP13, data for changing the order of the temperature detectors such that the second temperature detector should be changed to the first, the third temperature detector to the second and the first temperature detector to the third is restored in the data memory 74 to carry out a "selection order" setting operation for giving priority to a temperature detector which is not abnormal automatically.

(2) Control in accordance with the control processing flow of FIG. 2 is carried out by the control section 70 of a specific indoor unit 20 or the control section 70 of a specific heat source unit 10.

According to the present invention, a room temperature detected by the temperature detector of an operation unit or the temperature detector of a monitoring meter is selected as a substitute for a room temperature detected by a temperature detector provided in an indoor unit and used for the control of cooling or heating. When any one of the temperature detectors is abnormal, an alarm is displayed on the display section of a central monitoring and control board, and a temperature detector is selected in place of the abnormal temperature detector to control cooling or heating. Therefore, it is possible to provide a distributed air conditioning system which prevents such a situation that the operation of the entire system is stopped by an erroneous cooling or heating operation and can be maintained with ease.

What is claimed is:

1. A distributed air conditioning system for heating or cooling air in a room to be air conditioned by providing a heat operation fluid from a heat source unit to an indoor unit installed in the room based on operation conditions set by an operation unit, comprising a first temperature detector, provided in the indoor unit, for detecting the temperature of air in the room (to be referred to as "room temperature" hereinafter), a second temperature detector, provided in the operation unit, for detecting the room temperature, and a third temperature detector, provided in the room to be air conditioned to monitor the room temperature by means of a central monitoring and control board, for detecting the room temperature, wherein the system further comprises cooling or heating control means for controlling cooling or heating based on the room temperature detected by the second temperature detector or the third temperature detector.

2. A distributed air conditioning system for heating or cooling air in a room to be air conditioned by providing a heat operation fluid from a heat source unit to an indoor unit installed in the room based on operation conditions set by an operation unit, comprising a first temperature detector, provided in the indoor unit, for detecting the temperature of air in the room as room temperature, a second temperature detector, provided in the operation unit, for detecting the room temperature, and a third temperature detector, provided in the room to be air conditioned to monitor the room temperature by means of a central monitoring and control board, for detecting the room temperature, wherein the system further comprises:

order setting means for presetting the order of selecting one of the first temperature detector, the second temperature detector and the third temperature detector; and selection control means for controlling cooling or heating based on the room temperature detected by the next temperature detector selected according to the above order when the preceding temperature detector is abnormal.

3. A distributed air conditioning system for heating or cooling air in a room to be air conditioned by providing a heat operation fluid from a heat source unit to an indoor unit installed in the room based on operation conditions set by an operation unit, comprising a first temperature detector, provided in the indoor unit for controlling cooling or heating, for detecting the temperature of air in the room as room temperature, a second temperature detector, provided in the operation unit to monitor the room temperature by means of the operation unit, for detecting the room temperature, and a third temperature detector, provided in the room to be air conditioned to monitor the room temperature by means of a central monitoring and control board, for detecting the room temperature, wherein the system further comprises:

detection temperature substituting means for controlling cooling or heating based on the room temperature value detected by the second temperature detector or the third temperature detector as a substitute for the room temperature detected by the first temperature detector; and substitution control means for controlling the substitution by means of the central monitoring and control board according to a predetermined order.

4. A distributed air conditioning system for heating or cooling air in a room to be air conditioned by providing a heat operation fluid from a heat source unit to an indoor unit installed in the room based on operation conditions set by an operation unit, comprising a first temperature detector, provided in the indoor unit, for detecting the temperature of air in the room as room temperature, a second temperature detector, provided in the operation unit, for detecting the room temperature, and a third temperature detector, provided in the room to be air conditioned to monitor the room temperature by means of a central monitoring and control board, for detecting the room temperature, wherein the system further comprises:

alarm means for alarming that a temperature detector detecting a room temperature whose differences from room temperatures detected by the other temperature detectors are equal to or more than a predetermined value is abnormal; and cooling or heating control means for controlling cooling or heating based on the room temperature detected by one of the temperature detectors excluding the temperature detector which is abnormal.

* * * * *

UNITED STATES PATENT AND TRADEMARK OFFICE

CERTIFICATE OF CORRECTION

PATENT NO : 6,009,939
DATED : January 4, 2000
INVENTOR(S) : Ryoji Nakanishi, et al.

It is certified that error appears in the above-identified patent and that said Letters Patent are hereby corrected as shown below:

Front page [75], "Gunma-ken", should read --Ohra-gun--; and

Front page [75], "Saitama-ken", should read --Ohsato-gun--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*